US010604880B2

(12) United States Patent
Ekbundit

(10) Patent No.: US 10,604,880 B2
(45) Date of Patent: Mar. 31, 2020

(54) WASHING MACHINE APPLIANCES AND METHODS OF OPERATION

(71) Applicant: Haier US Appliance Solutions, Inc., Wilmington, DE (US)

(72) Inventor: Michael Wuttikorn Ekbundit, Mount Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 189 days.

(21) Appl. No.: 15/698,782

(22) Filed: Sep. 8, 2017

(65) Prior Publication Data

US 2019/0078251 A1 Mar. 14, 2019

(51) Int. Cl.

| | |
|---|---|
| ***D06F 37/20*** | (2006.01) |
| ***D06F 17/10*** | (2006.01) |
| ***D06F 33/02*** | (2006.01) |
| *D06F 39/12* | (2006.01) |

(52) U.S. Cl.

CPC ..... *D06F 37/203* (2013.01); *D06F 17/10* (2013.01); *D06F 33/02* (2013.01); *D06F 39/125* (2013.01); *D06F 2202/065* (2013.01); *D06F 2202/12* (2013.01); *D06F 2204/065* (2013.01); *D06F 2204/086* (2013.01); *D06F 2204/10* (2013.01); *D06F 2222/00* (2013.01)

(58) Field of Classification Search

CPC ..... D06F 17/10; D06F 33/02; D06F 37/20; D06F 37/203; D06F 2202/12; D06F 2202/065; D06F 2204/065; D06F 2204/086; D06F 2204/10; D06F 2222/00

See application file for complete search history.

(56) References Cited

U.S. PATENT DOCUMENTS

| | | | | |
|---|---|---|---|---|
| 6,134,926 | A | 10/2000 | Vande Haar et al. | |
| 2002/0120419 | A1* | 8/2002 | Steffen | D06F 37/203 702/96 |
| 2009/0009287 | A1* | 1/2009 | Falcioni | A47L 15/0063 340/10.1 |
| 2010/0175199 | A1* | 7/2010 | Kim | D06F 37/203 8/137 |
| 2014/0352079 | A1* | 12/2014 | Erickson | D06F 33/02 8/137 |
| 2016/0312394 | A1* | 10/2016 | Wang | D06F 37/22 |
| 2017/0121881 | A1* | 5/2017 | Yang | D06F 39/005 |
| 2018/0119325 | A1* | 5/2018 | Kim | D06F 33/02 |

FOREIGN PATENT DOCUMENTS

| | | | |
|---|---|---|---|
| CN | 1715497 | A | 1/2006 |
| CN | 106012421 | A | 10/2016 |
| DE | 102015106849 | A1 | 11/2016 |
| JP | 4900407 | B2 | 3/2012 |

* cited by examiner

*Primary Examiner* — Joseph L. Perrin

(74) *Attorney, Agent, or Firm* — Dority & Manning, P.A.

(57) ABSTRACT

A washing machine appliance, including methods of operation, is provided herein. The washing machine appliance may include a cabinet, a tub, and a rotation element mounted therein. The method may include flowing a volume of liquid into the tub; rotating the rotation element within the tub; measuring an angular position of the cabinet relative to a fixed axis after the flowing; comparing the measured angular position of the cabinet to a predetermined threshold; and adjusting a voltage within the washing machine appliance in response to the measured angular position exceeding the predetermined threshold.

8 Claims, 5 Drawing Sheets

WASHING MACHINE APPLIANCES AND METHODS OF OPERATION

FIELD OF THE INVENTION

The present subject matter relates generally to washing machine appliances and methods for operating a washing machine appliance based on a position thereof.

BACKGROUND OF THE INVENTION

Washing machine appliances generally include a cabinet which receives a tub for containing wash and rinse water. A wash basket is rotatably mounted within the wash tub. A drive assembly is coupled to the wash tub and configured to rotate the wash basket within the wash tub in order to cleanse articles within the wash basket. Upon completion of a wash cycle, a pump assembly can be used to rinse and drain soiled water to a draining system.

Washing machine appliances include vertical axis washing machine appliances and horizontal axis washing machine appliances, where "vertical axis" and "horizontal axis" refer to the axis of rotation of the wash basket within the wash tub. Irrespective of the axis, washing machine appliances may include multiple corners or support feet on which a particular appliance rests. In certain situations, a washing machine appliance may become tilted from its support feet and fall over. For example, an extreme imbalance (e.g., caused by an inappropriately sized or distributed load within the washing machine appliance) may rock the cabinet until the washing machine falls on one of its sides. As another example, the support surface on which the cabinet rests (e.g., the floor) may crack or break, causing the washing machine to become imbalanced and fall. Once the washing machine appliance has fallen, one or more moving or electrified portions of the washing machine appliance may become exposed to the user. This may include the drive assembly, which rotates the basket within the tub. Aside from potentially damaging the washing machine appliance itself, exposure of such portions may risk damaging or injuring nearby appliances or users.

Some existing washing machine appliances may include features for confirming that the cabinet of a washing machine appliance is level before operations begin (e.g., during installation). However, typical existing appliances fail to provide any features for ensuring appliance or user safety once the washing machine appliance has fallen. In many cases, a user is required to turn off or unplug the washing machine appliance once the cabinet has moved onto its side. Furthermore, typical existing appliances fail to provide any features for preventing such unsafe conditions from occurring.

Accordingly, a need exists for a washing machine appliance that includes features for addressing one or more of the above-identified issues. In particular, a washing machine appliance that includes features for minimizing the potential or risk of the appliance in a fallen state be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, a method for operating a washing machine appliance is provided. The washing machine appliance may include a cabinet, a tub, and a rotation element mounted therein. The method may include flowing a volume of liquid into the tub; rotating the rotation element within the tub; measuring an angular position of the cabinet relative to a fixed axis after the flowing; comparing the measured angular position of the cabinet to a predetermined threshold; and adjusting a voltage within the washing machine appliance in response to the measured angular position exceeding the predetermined threshold.

In another aspect of the present disclosure, a washing machine appliance is provided. The washing machine appliance may include, a cabinet, a tub housed within the cabinet, a rotation element, a measurement device, a motor, and a controller. The rotation element may be rotatably mounted within the tub. The measurement device may be attached to the cabinet. The motor may be in mechanical communication with the rotation element. The motor may be configured for selectively rotating the rotation element within the tub. The controller may be in operative communication with the motor and the measurement device. The controller may be configured to initiate an operation cycle. The operation cycle may include flowing a volume of liquid into the tub, rotating the rotation element within the tub, receiving a position signal from the measurement device, measuring an angular position of the cabinet relative to a fixed axis after the flowing, the measuring being based on the received position signal, comparing the measured angular position of the cabinet to a predetermined threshold, and adjusting a voltage within the washing machine appliance in response to the measured angular position exceeding the predetermined threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
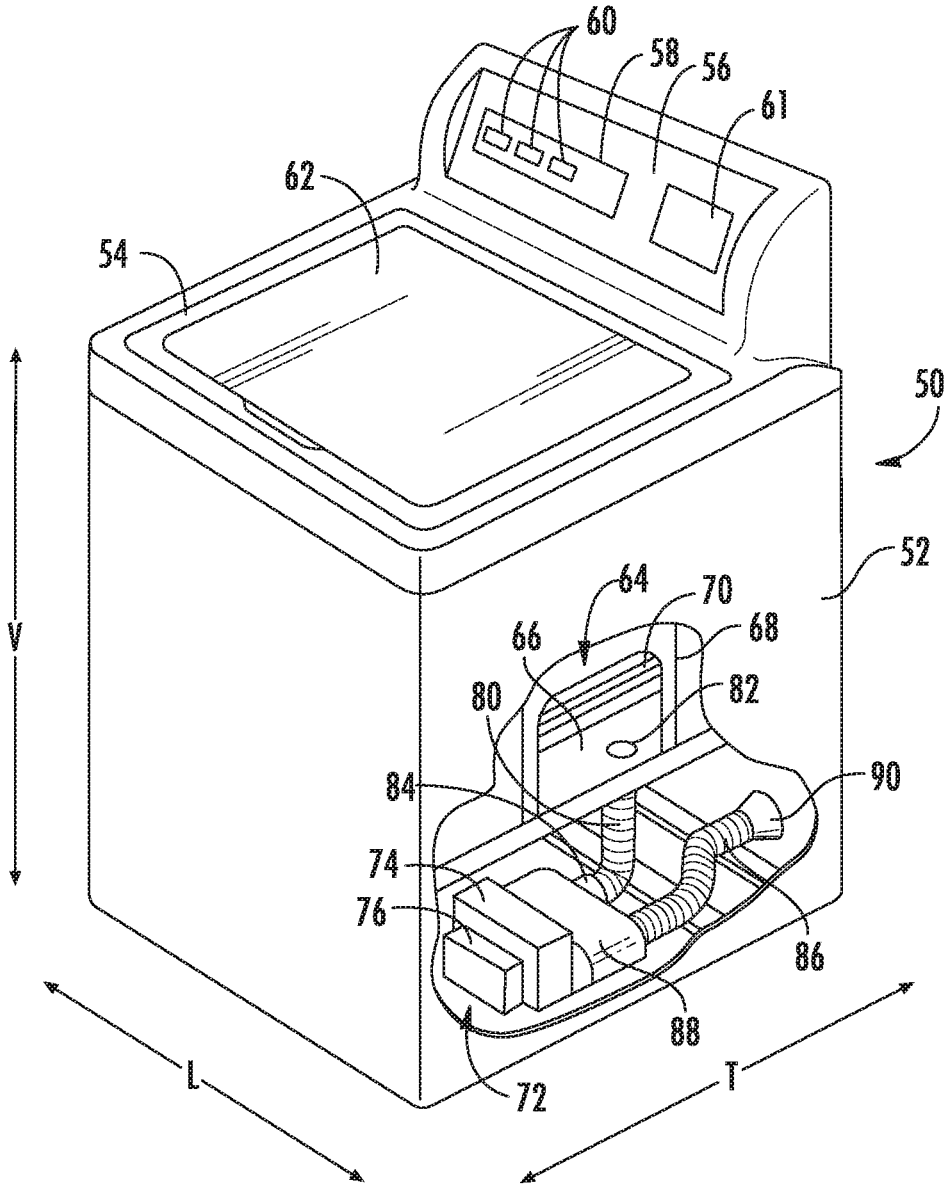
FIG. 1 provides a perspective view of a washing machine appliance, with a portion of a cabinet of the washing machine appliance shown broken away in order to reveal certain interior components of the washing machine appliance, according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Turning now to the figures, FIG. 1 provides a perspective view partially broken away of a washing machine appliance 50 according to exemplary embodiments of the present disclosure. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

Generally, appliance 50 defines a vertical direction V, a lateral direction L and a transverse direction T when mounted in a level position. As illustrated, the vertical direction V is perpendicular to a level support surface on which the cabinet 52 is mounted. Moreover, the vertical direction V, lateral direction L and transverse direction T are mutually perpendicular and form an orthogonal direction system.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
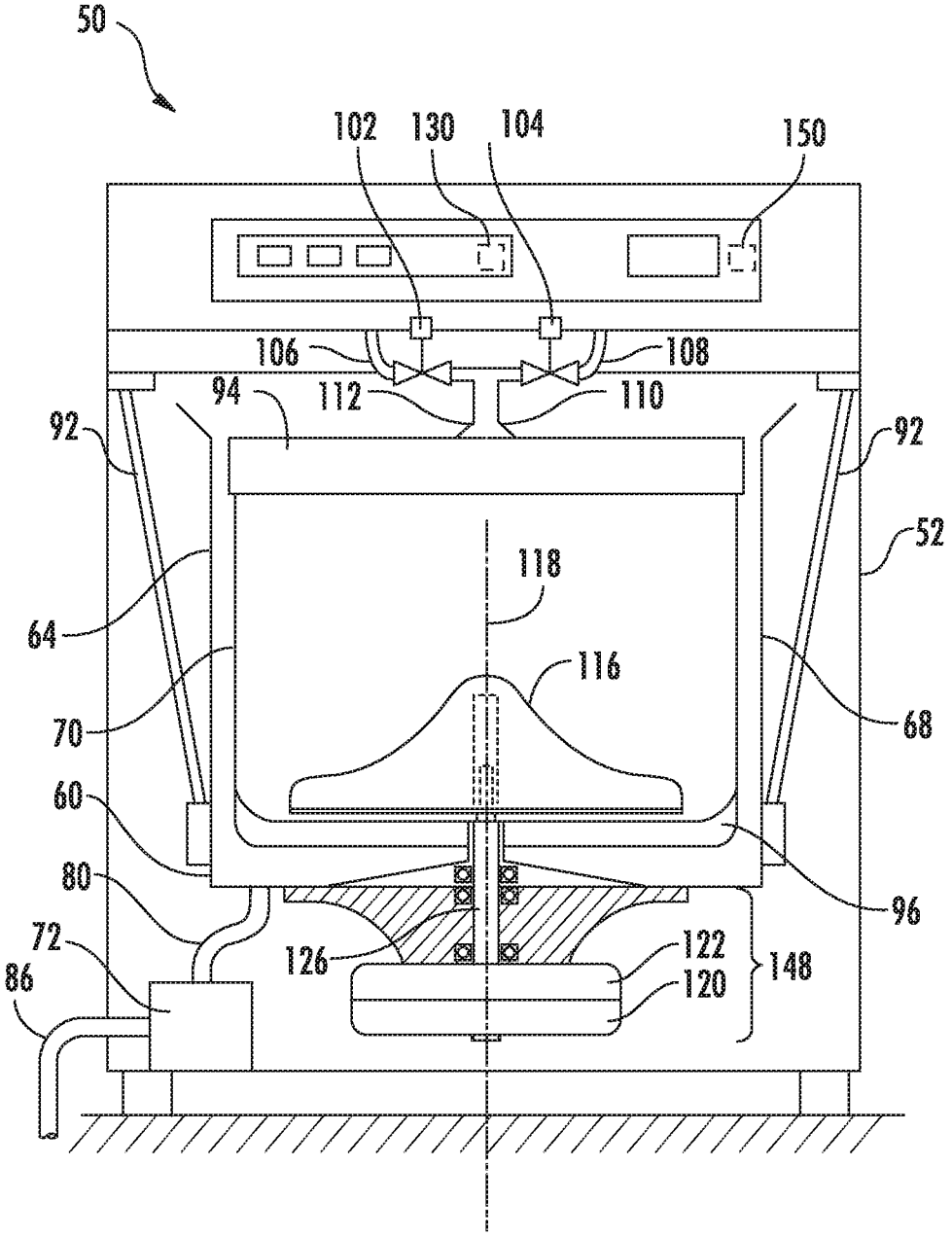
FIG. 2 provides a front elevation schematic view of various components of the exemplary washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

In some embodiments, an agitation element 116, such as a vane agitator, impeller, auger, or oscillatory basket mechanism, or some combination thereof is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 (i.e., rotated about the vertical axis 118) through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referenced herein as a motor assembly 148.

Basket 70, tub 64, and motor assembly 148 are supported by a vibration damping suspension system 92. The damping suspension system 92 can include a plurality of damping elements, such as piston-casing damping elements, coupled to the wash tub 64. The damping suspension system 92 can include other elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

Damping suspension system 92 operates to dampen dynamic motion as the wash basket 70 rotates within the wash tub 64. The damping suspension system 92 has various natural operating frequencies of the dynamic system. These natural operating frequencies are referred to as the modes of suspension for the washing machine. For instance, the first mode of suspension for the washing machine occurs when the dynamic system including the wash basket 70, tub 64, and damping suspension system 92 are operating at the first resonant or natural frequency of the dynamic system.

Operation of washing machine appliance 50 is controlled by a controller 150 that is operatively coupled (e.g., electrically coupled or wirelessly coupled) to the user interface input located on washing machine backsplash 56 (FIG. 1) for user manipulation to select washing machine cycles and features. In response to user manipulation of the user interface input, controller 150 operates the various components of washing machine appliance 50 to execute selected machine cycles and features.

Controller 150 may include a memory (e.g., non-transitory storage media) and microprocessor, such as a general or special purpose microprocessor operable to execute programming instructions or micro-control code associated with a washing operation or cycle. The memory may represent random access memory such as DRAM, or read only memory such as ROM or FLASH. In one embodiment, the processor executes programming instructions stored in memory (e.g., as software). The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 (such as motor assembly 148 and measurement devices 130—discussed herein) may be coupled to, or otherwise in communication with, controller 150 via one or more signal lines or shared communication busses to provide signals to and/or receive signals from the controller 150. Optionally, a measurement device 130 may be included with controller 150. Moreover, measurement devices 130 may include a microprocessor that performs the calculations specific to the measurement of motion with the calculation results being used by controller 150.

In specific embodiments, one or more measurement devices 130 are provided in the washing machine appliance 50 for measuring movement of the cabinet 52 during one or more portions of a wash cycle (e.g., an agitation phase, a rinse phase, a spin phase, etc.). Generally, movement may be measured from one or more angular speeds and/or accelerations, detected at the one or more measurement devices 130. Measurement devices 130 be attached (e.g., directly or indirectly) to cabinet 52 and may measure a variety of suitable variables, which can thus be correlated to relative movement of the cabinet 52.

A measurement device 130 in accordance with the present disclosure may include an accelerometer, which measures translational motion, such as acceleration along one or more directions (e.g., along a predetermined fixed X-axis, Y-axis, and/or Z-axis). Additionally or alternatively, a measurement device 130 may include a gyroscope, which measures rotational motion, such as rotational velocity about an axis. In some embodiments, measurement device 130 is mounted to on or within backsplash 56 to sense movement of the cabinet 52 by measuring uniform periodic motion, non-uniform periodic motion, and/or excursions during appliance 50 operation. In additional or alternative embodiments, measurement device 130 is mounted to a separate portion of appliance 50. For instance, measurement device 130 may be mounted to the tub 64 (e.g., bottom wall 66 or a sidewall 68 thereof) to sense movement of the tub 64 relative to the cabinet 52 by measuring uniform periodic motion, non-uniform periodic motion, and/or excursions of the tub 64 during appliance 50 operation.

In exemplary embodiments, a measurement device 130 may include at least one gyroscope and/or at least one accelerometer. The measurement device 130, for example, may be a printed circuit board that includes the gyroscope and accelerometer thereon. The measurement device 130 may be mounted to the cabinet 52 (e.g., via a suitable mechanical fastener, adhesive, etc.) and may be oriented such that the various sub-components (e.g., the gyroscope and accelerometer) are oriented to measure movement along or about particular directions. Notably, the gyroscope and accelerometer in may be mounted at a single location (e.g., the location of the printed circuit board or other component of the measurement device 130 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on cabinet 52 can measure the rotation of an accelerometer located at a different location on cabinet 52.

In an illustrative embodiment, articles (e.g., laundry items) are loaded into basket 70, and washing operation is initiated through operator manipulation of control input selectors 60 (shown in FIG. 1). Tub 64 is filled with water and mixed with detergent to form a wash fluid and a one or more potions of the appliance 50 may be rotated. In some such embodiments, rotation element is rotated by motor 120. For instance, the rotation element may include agitation element 116. Basket 70 may be agitated with agitation element 116 for cleansing of laundry items in basket 70. That is, agitation element 116 is rotated back and forth in an oscillatory back and forth motion (e.g., while basket 70 remains generally stationary—i.e., not actively rotated). In the illustrated embodiment, agitation element 116 is rotated clockwise a specified amount about the vertical axis 118 of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

Additionally or alternatively, the rotation element may include basket 70, which may be rotated about the vertical axis 118. In some such embodiments, after the agitation phase of the wash cycle is completed, tub 64 is drained with pump assembly 72. Laundry items are then rinsed. Upon being rinsed, basket 70 may be rotated in a spin phase. Subsequently, portions of the cycle may be repeated, including the agitation phase, depending on the particulars of the wash cycle selected by a user.

Figure 3:
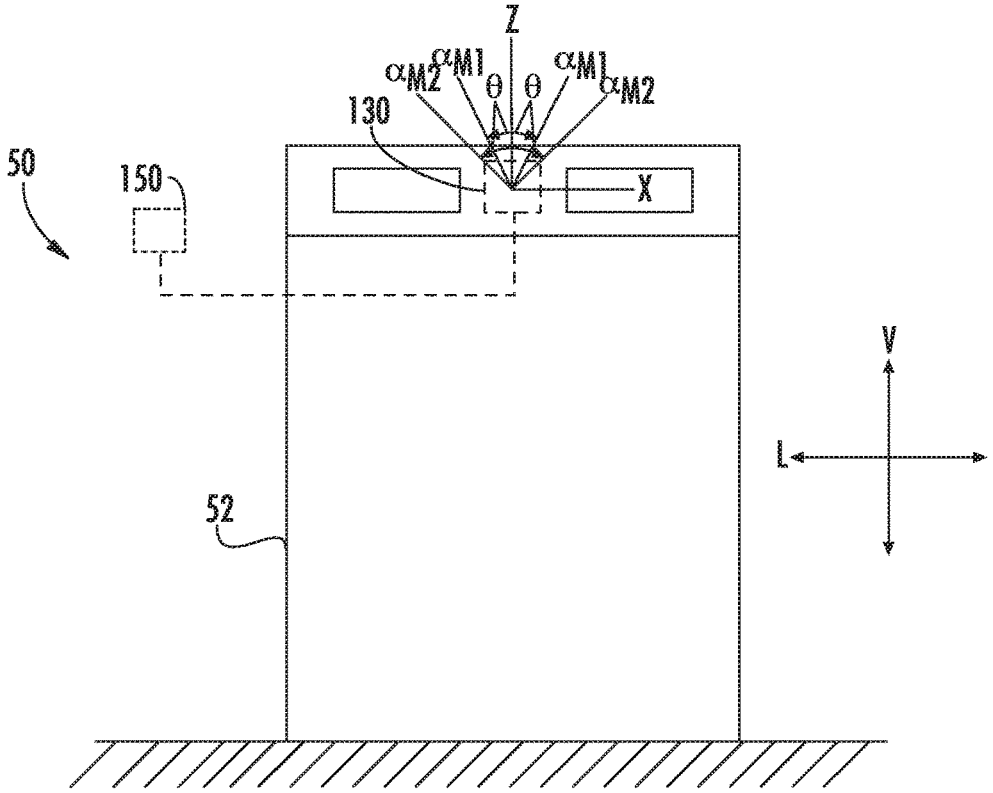
FIG. 3 provides a front plan view of an example washing machine appliance, in accordance with exemplary embodiments of the present disclosure.
Figure 4:
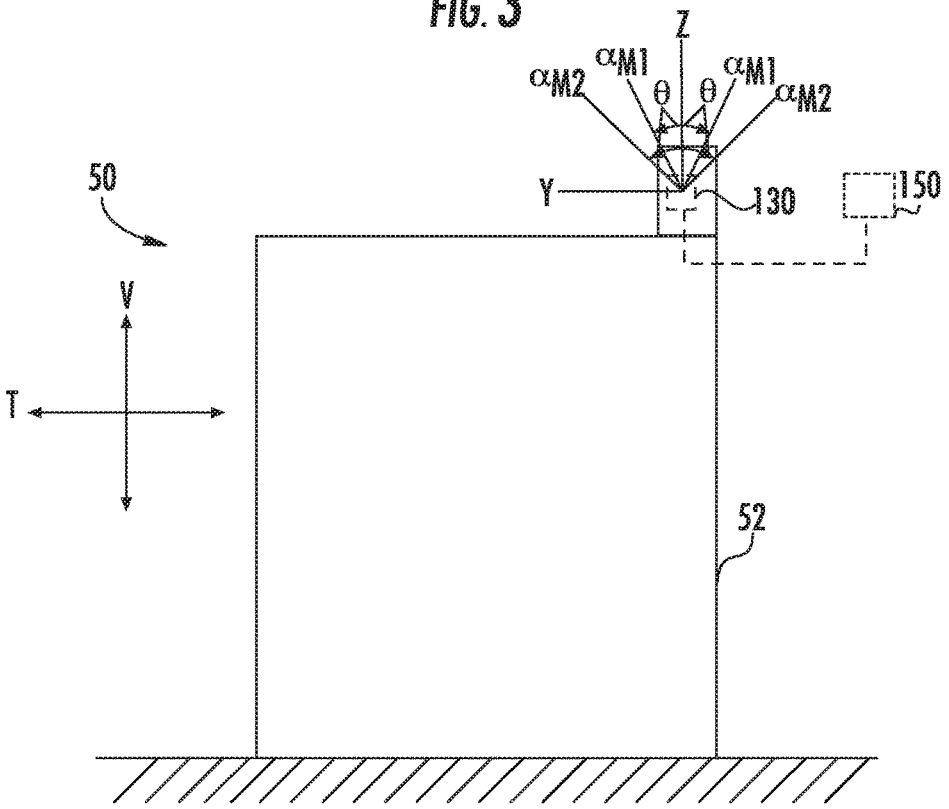
FIG. 4 provides a side plan view of the washing machine appliance of FIG. 3.

As illustrated in FIGS. 3 and 4, measurement device 130 may be configured to detect the angular position θ (e.g., in degrees) of measurement device 130, and thereby cabinet 52, relative to a fixed axis or direction during certain operations. In some such embodiments, before or immediately after an operation cycle is initiated, such as before or during installation of appliance 50, measurement device 130 may set one or more fixed reference axes or directions. For instance, the accelerometer of measurement device 130 may define a fixed Z-axis parallel to a gravitational force and/or the vertical direction V. Additionally or alternatively, the accelerometer of measurement device 130 may define one or more horizontal axes perpendicular to the gravitational force (e.g., an X-axis and a Y-axis). During use, the controller 150 may actively monitor or measure the position (e.g., angular position θ) of measurement device 130 relative to a fixed axis (e.g., Z-axis, X-axis, and/or Y-axis). In some such embodiments, the accelerometer of measurement device 130 may transmit one or more acceleration signals to controller 150. Based on the received signals, the controller 150 may thus calculate the angular position θ (i.e., angle relative to one or more of the fixed axes) of measurement device 130, and thereby cabinet 52. Optionally, the controller 150 may receive acceleration signals repeatedly (e.g., according to a predetermined time interval). In turn, the controller 150 may continuously monitor the angular position θ of the cabinet 52 during operation of washing machine appliance 50.

In some embodiments, controller 150 automatically (i.e., without further user input) compares the measured angular position θ to one or more predetermined thresholds $\alpha_{M1}$, $\alpha_{M2}$. The predetermined thresholds $\alpha_{M1}$, $\alpha_{M2}$ may be defined relative to the same fixed axis or axes as the measured angular position θ. For instance, the one or more predetermined thresholds $\alpha_{M1}$, $\alpha_{M2}$ may include a first threshold $\alpha_{M1}$ and a second threshold $\alpha_{M2}$ that are stored within the memory of controller 150. Optionally, the second threshold $\alpha_{M2}$ may be greater than the first threshold $\alpha_{M1}$. In embodiments wherein the angular position θ is repeatedly measured, each new measurement may be compared to the one or more predetermined thresholds $\alpha_{M1}$, $\alpha_{M2}$. Thus, controller 150 may thus determine when the cabinet 52 moves or is tilted to a position that exceeds one or more predetermined threshold.

Based on the measured angular position θ, controller 150 may adjust (e.g., set or change) one or more condition within washing machine appliance 50. For instance, controller 150 may adjust a voltage within washing machine appliance 50. In other words, controller 150 may set or limit an electrical voltage delivered to one or more components, such as motor 120 (FIG. 2), from a power source (not pictured). Optionally, controller 150 may adjust voltage by halting the voltage or current to one or more components (e.g., motor 120). Additionally or alternatively, controller 150 may prevent motor 120 from rotating basket 70 (FIG. 2) and/or agitation element 116 (FIG. 2). Advantageously, the described steps may prevent a user from being exposed to a component (e.g., motor 120) while it is moving and/or electrified (i.e., receiving an electrical current or voltage from the power source).

In further additional or alternative embodiments, controller 150 adjusts voltage by merely reducing the voltage to a component (e.g., to a voltage that is greater than zero and/or less than the unaltered or previous voltage transmitted to the component prior to the adjustment). Optionally, the rotation speed of the motor 76 may be reduced due to the decreased voltage. If the washing machine appliance 50 is rocking or otherwise in danger of falling over, the reduced rotation speed may prevent such a fall. In turn, washing machine appliance 50 may be advantageously prevented from falling over.

Figure 5:
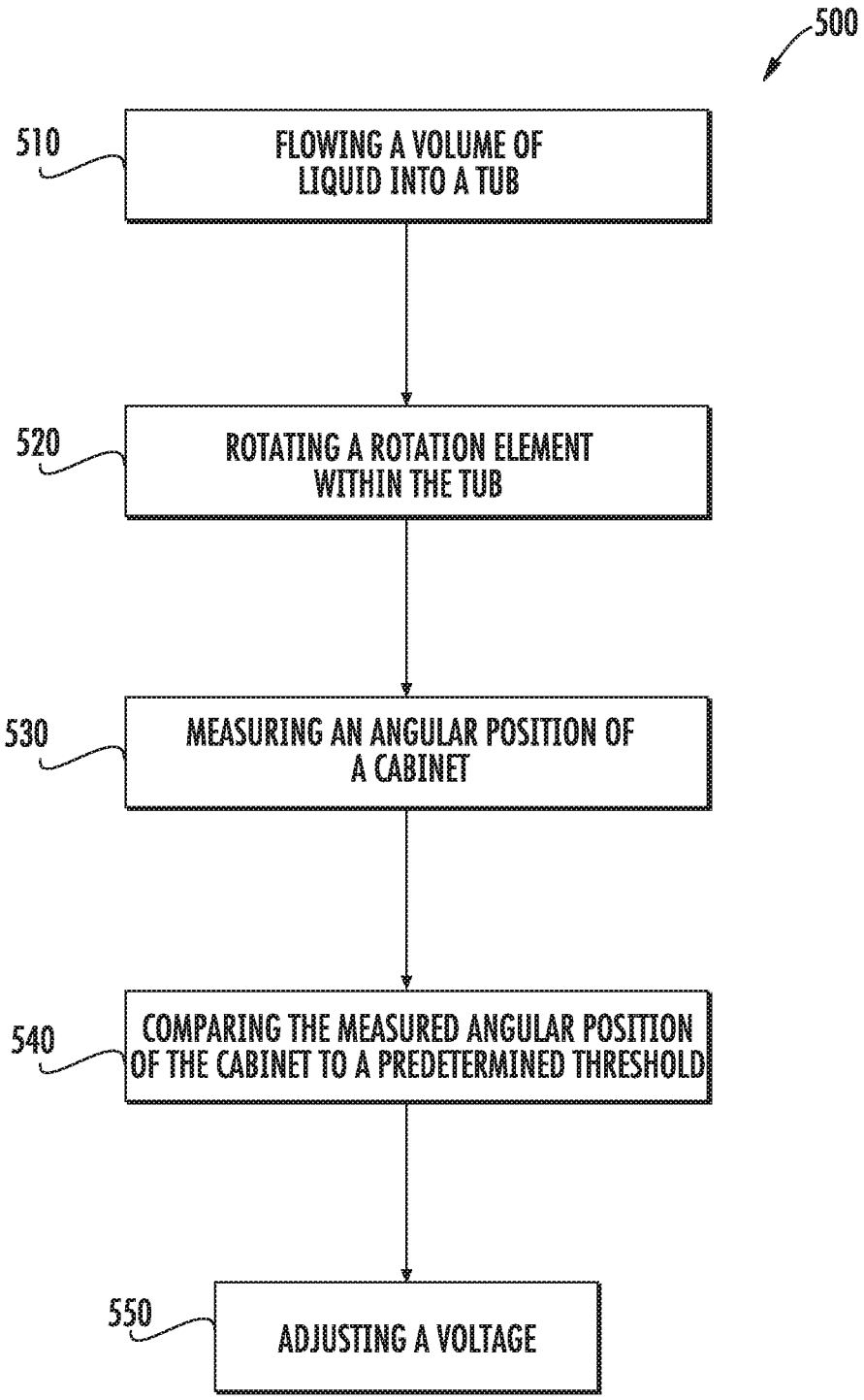
FIG. 5 provides a flow chart illustrating a method for operating a washing machine appliance in accordance with exemplary embodiments of the present disclosure.
Figure 6:
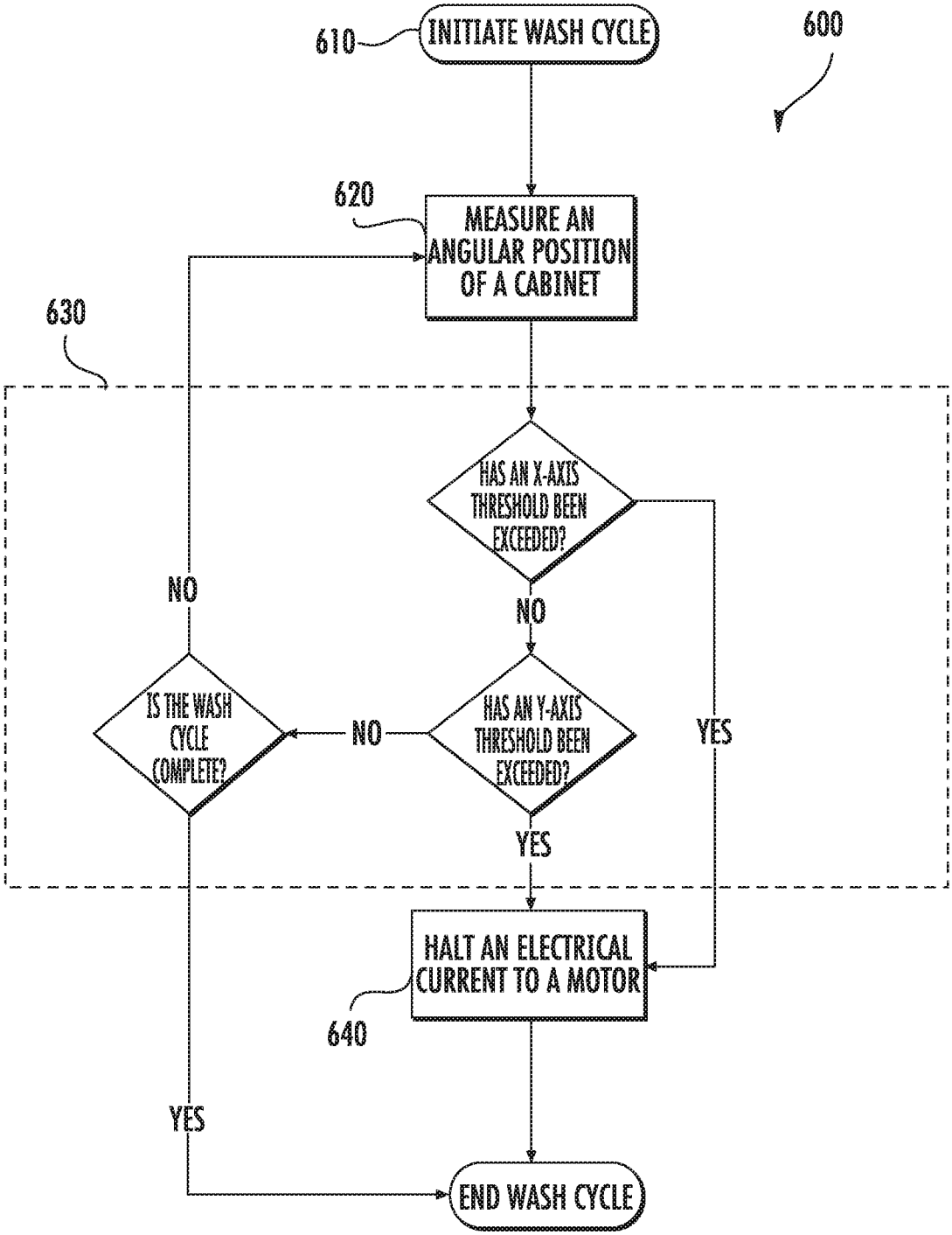
FIG. 6 provides a flow chart illustrating another method for operating a washing machine appliance in accordance with exemplary embodiments of the present disclosure.

Referring now to FIGS. 5 and 6, various methods may be provided for use with washing machine appliances (e.g., washing machine appliance 50) in accordance with the present disclosure. In general, the various steps of methods as disclosed herein may, in exemplary embodiments, be performed by the controller 150 as part of an operative cycle (e.g., wash cycle) that the controller 150 is configured to initiate. During such methods, controller 150 may receive inputs and transmit outputs from various other components of the appliance 50. For example, controller 150 may send signals to and receive signals from motor assembly 148 (including the motor 120), control panel 58, one or more measurement device 130, pump assembly 72, and/or valves 102, 104. In particular, the present disclosure is further directed to methods, as indicated by reference numbers 500 and 600, for operating washing machine appliance. Such methods advantageously facilitate balancing and monitoring the stability of the washing machine appliance 50. In exemplary embodiments, such balancing and monitoring is performed during the movement and use of washing machine appliance 50 (e.g., when the basket 70 and/or agitation element 116 are rotated).

FIGS. 5 and 6 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

Turning specifically to FIG. 5, a method 500 is illustrated. At 510, the method 500 may include flowing a volume of a liquid into the tub. The liquid may include water, and may further include one or more additives as discussed above. The water may be flowed through the hot liquid hose and/or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 520, the method 500 may include rotating a rotation element within the tub. For instance, the motor may rotate (e.g., oscillate or spin) the basket within the tub at the set dwell speed (e.g., in rotations per minute) for a predetermined time period (i.e., a predetermined amount of time). In some such embodiments, 520 follows 510 and/or another phase, such as an agitation phase, rinse phase, drain phase, etc. In additional or alternative embodiments, the motor may rotate (e.g., oscillate or spin) the agitation element within the tub and basket. Optionally, the pump assembly may draw water (e.g., at least a portion of the volume of liquid from 510) away from the tub before rotating begins. Thus, an electrical current, including a voltage, may be directed to the motor and/or pump assembly at 520.

At 530, the method 500 may include measuring an angular position of the cabinet relative to a fixed axis (e.g., a Z-axis, Y-axis, or X-axis). As described above, 530 may include receiving an acceleration signal from an accelerometer attached to the cabinet. Based on the received acceleration signal, for instance, the controller may determine the angular position of the measurement device and, thereby, the cabinet. Optionally, 530 may occur after the flowing at 510. In certain embodiments, 530 may occur during 520.

At 540, the method 500 may include comparing the measured angular position of the cabinet at 530 to a predetermined threshold. The predetermined threshold may be defined relative to the same fixed axis or axes as the measured angular position of 530. Optionally, multiple discrete predetermined thresholds may be included. For instance, a first threshold and a second threshold that is greater than the first threshold may be included. In some embodiments, 530 and 540 are repeated (e.g., at a predetermined time interval and/or during 520) to continuously monitor the angular position of the cabinet.

In some embodiments, 530 and 540 may be repeated throughout the course of the wash cycle. For example, new or subsequent measurements and comparisons may be performed during step 520. Additionally or alternatively, new or subsequent measurements and comparisons may be performed during various other phases and/or rotation speeds.

At 550, the method 500 may include adjusting a voltage within the washing machine appliance in response to the measured angular position exceeding the predetermined threshold at 540. In some embodiments, 550 includes reducing the voltage to a value that is greater than zero volts. In additional or alternative embodiments, 550 includes halting an electrical current through the washing machine appliance (e.g., to one or more components within the washing machine appliance, such as the motor). Optionally, 550 may include preventing rotation of a motor rotatably mounted to the rotation element (e.g., before the programmed end point or time of the current or contemporary operation cycle). If the predetermined threshold is not exceeded (i.e., the measured angular position is less than or equal to the predetermined threshold), the operation cycle may continue. For instance, the unaltered electrical current and voltage transmitted to one or more components of the washing machine appliance at 520 may be permitted to continue without interruption (e.g., until the current phase or operation cycle is complete). Moreover, a wash cycle may continue without interruption as long as the predetermined threshold at 540 is not exceeded.

In embodiments wherein multiple thresholds are included, discrete responses may be provided for each threshold. For instance, 550 may include halting an electrical current within the washing machine appliance in response to the measured angular position exceeding the second threshold. In response to the measured threshold exceeding the first threshold, 550 may include reducing the voltage to a value that is greater than zero volts (e.g., such that the rotation speed of the rotation element is reduced).

Turning specifically to FIG. 6, a method 600 is illustrated. At 610, the method 600 may include initiating a wash cycle (e.g., as directed by a user input signal from the user interface). In some embodiments, 610 may include flowing a volume of a liquid into the tub. The liquid may include water, and may further include one or more additives as discussed above. The water may be flowed through the hot liquid hose and/or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

In additional or alternative embodiments, 610 may include rotating the rotation element within the tub (e.g., after the volume of liquid has been flowed into the tub. For instance, the motor may rotate (e.g., oscillate or spin) the basket within the tub at the set dwell speed (e.g., in rotations per minute) for a predetermined time period (i.e., a predetermined amount of time). In additional or alternative embodiments, the motor may rotate (e.g., oscillate or spin) the agitation element within the tub and basket. Moreover, the pump assembly may draw water (e.g., at least a portion of the volume of liquid) away from the tub before rotation begins. Thus, an electrical current, including a voltage, may be directed to the motor and/or pump assembly at 610.

At 620, the method 600 may include measuring an angular position of the cabinet relative to a fixed axis (e.g., a Z-axis, Y-axis, or X-axis). As described above, 620 may include receiving an acceleration signal from an accelerometer attached to the cabinet. Based on the received acceleration signal, for instance, the controller may determine the angular position of the measurement device and, thereby, the cabinet. Optionally, 620 may occur after the flowing and/or during the rotating at 610. Moreover, 620 may provide the angular position of the cabinet relative to multiple horizontal axes, such as an X-axis and a Y-axis, simultaneously (e.g., at the same point in time).

At 630, the method 600 may include evaluating the angular position of the cabinet. Specifically, 630 includes comparing the measured angular position relative to multiple horizontal axes. In some such embodiments, the measured angular position of the cabinet relative to the X-axis is compared to a predetermined X-axis threshold. Moreover, the measured angular position of the cabinet relative to the Y-axis is compared to a predetermined Y-axis threshold.

If neither the X-axis threshold nor the Y-axis threshold is exceeded, the method 600 may include determining whether the initiated wash cycle has been completed. If the wash cycle has not been completed, the method 600 may return to 620 to measure a new angular position. If the wash cycle has been completed, the method 600 may end.

By contrast, if one or both of the X-axis threshold or the Y-axis threshold is exceeded, the method 600 may immediately proceed to 640. At 640, an electrical current through the washing machine appliance (e.g., to one or more components within the washing machine appliance, such as the motor). Optionally, 640 may include preventing rotation of a motor rotatably mounted to the rotation element (e.g., before the programmed end point or time of the initiated wash cycle).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a cabinet;
- a tub housed within the cabinet;
- a pump assembly mounted within the cabinet in fluid communication with the tub to selectively drain the tub;
- a rotation element rotatably mounted within the tub;
- a measurement device attached to the cabinet;
- a motor in mechanical communication with the rotation element, the motor configured for selectively rotating the rotation element within the tub; and
- a controller in operative communication with the motor and the measurement device, the controller configured to initiate an operation cycle comprising
  - flowing a volume of liquid into the tub,
  - rotating the rotation element within the tub,
  - receiving a position signal from the measurement device,
  - measuring an angular position of the cabinet in degrees in which the cabinet is tilted relative to a fixed axis after the flowing, the measuring being based on the received position signal, and wherein the measuring occurs during the rotating,
  - comparing the measured angular position of the cabinet to a predetermined threshold, and
  - adjusting a voltage within the washing machine appliance in response to the measured angular position exceeding the predetermined threshold,
  - wherein the adjusting comprises halting an electrical current through the washing machine appliance.

2. The washing machine appliance of claim 1, wherein the adjusting comprises reducing the voltage to a value that is greater than zero volts.

3. The washing machine appliance of claim 1, wherein the adjusting comprises preventing rotation of the motor.

4. The washing machine appliance of claim 1, wherein the predetermined threshold is a first threshold, wherein the operation cycle further comprises halting an electrical current within the washing machine appliance in response to the measured angular position exceeding a second threshold, the second threshold being greater than the first threshold.

5. The washing machine appliance of claim 4, wherein the adjusting comprises reducing the voltage to a value that is greater than zero volts.

6. The washing machine appliance of claim 1, wherein the rotation element comprises a basket rotatably mounted within the tub, the basket defining a chamber for receipt of articles for washing.

7. The washing machine appliance of claim 1, wherein the measurement device comprises an accelerometer, and wherein the measuring comprises receiving an acceleration signal from the accelerometer.

8. A washing machine appliance comprising:

a cabinet;

a tub housed within the cabinet;

a rotation element rotatably mounted within the tub;

a measurement device attached to the cabinet;

a motor in mechanical communication with the rotation element, the motor configured for selectively rotating the rotation element within the tub; and a controller in operative communication with the motor and the measurement device, the controller configured to initiate an operation cycle comprising flowing a volume of liquid into the tub, rotating the rotation element within the tub via the motor subsequent to flowing the volume of liquid, receiving a position signal from the measurement device, measuring an angular position of the cabinet in degrees in which the cabinet is tilted relative to a fixed axis after the flowing, the measuring being based on the received position signal, and wherein the measuring occurs during the rotating, comparing the measured angular position of the cabinet to a predetermined threshold, and adjusting a voltage within the washing machine appliance in response to the measured angular position exceeding the predetermined threshold, wherein the adjusting comprises halting an electrical current through the washing machine appliance to the motor and the pump assembly.

* * * * *